US005662061A

United States Patent [19]

Salathe

[11] Patent Number: 5,662,061

[45] Date of Patent: Sep. 2, 1997

[54] UTILITY CONTAINER HAVING MULTIPLE, SEPARATE COMPARTMENTS WITH STABILITY, LOAD SHIFTING PREVENTION FEATURES

[76] Inventor: Gregg Joseph Salathe, 4705 S. Connor Ave., Springfield, Mo. 65804-7516

[21] Appl. No.: 609,103

[22] Filed: Feb. 29, 1996

[51] Int. Cl.[6] ..... B63B 35/00

[52] U.S. Cl. ..... 114/347; 114/363

[58] Field of Search ..... 114/343, 347, 114/364, 61, 363; 224/406

[56] References Cited

U.S. PATENT DOCUMENTS

| | | | |
|---|---|---|---|
| D. 273,074 | 3/1984 | Mathieu | D7/77 |
| 3,958,289 | 5/1976 | Carlson | 114/347 |
| 4,146,279 | 3/1979 | Stahel | 312/235 |
| 4,398,488 | 8/1983 | Mathieu | 114/343 |
| 4,528,925 | 7/1985 | Pyburn | 114/61 |
| 4,593,642 | 6/1986 | Shay | 114/347 |
| 5,050,526 | 9/1991 | Nelson | 114/364 |

OTHER PUBLICATIONS

"How to Select Canoes", Bass Pro Shops Outdoor World brochure undated.

*Primary Examiner*—Jesus D. Sotelo

*Attorney, Agent, or Firm*—Raymond G. Areaux; Jacqueline M. Daspit

[57] ABSTRACT

The present invention relates to a removable utility container or cooler for a canoe. More particularly, the present invention consists of a removable utility container for a canoe which has multiple separate and distinct interior compartments which may be used to store wet or dry goods. Additionally, the present invention has the novel and useful feature of preventing load shifts of the contents of the compartments which would normally result in loss of the canoe contents, taking on water, and ultimately, capsizing. Another benefit is the ability to utilize the present invention as an additional seat for another canoeist.

14 Claims, 7 Drawing Sheets

UTILITY CONTAINER HAVING MULTIPLE, SEPARATE COMPARTMENTS WITH STABILITY, LOAD SHIFTING PREVENTION FEATURES

BACKGROUND OF THE INVENTION

The present invention relates to utility containers or coolers for canoes. More particularly, the present invention relates to a removable container with multiple vertical interior walls which create multiple interior compartments that may function as coolers, carrying cases and/or storage compartments. The present invention is a design with stabilizing features that fit and function conveniently in canoes, while circumventing problems due to load shifts.

When canoeing, canoeists can find themselves pinned against objects, such as trees or rocks, by the current of a swiftly moving river or stream. When in this situation, canoeists typically lean to the downstream side to prevent the current, passing under the canoe from the broadside, from rotating the canoe in the upstream direction. As the canoe rotates, the contents of the canoe, including containers, ice chests and other stored items, move about in the canoe, creating conditions for taking on water, loss of the canoe contents, and ultimately, capsizing.

To solve this problem, the present invention was developed to provide a removable container with multiple vertical dividing walls creating multiple storage compartments, which offers a low center of gravity and features baffles for preventing load shifting. The multiple compartments are sufficiently separated such that one or more of the compartments may be utilized as an ice chest or cooler without the problem of the contents of one compartment shifting into the other compartments. Additionally, the multiple compartments are sufficiently watertight such that when closed, a seal is formed to prevent water from spilling from one compartment to another at a rate which would adversely affect the load-shifting inhibition features of the present invention.

While the prior art discloses devices and designs for canoe storage or for cooler applications, none disclose the novel combination of features of the present invention. For example, U.S. Pat. No. 3,958,289 to Carlson discloses a watertight storage compartment for a canoe designed for holding articles that otherwise would be subject to movement within the canoe. Further, Carlson Patent '289 teaches a single storage compartment for a canoe with a pair of opposing handles for attachment to the gunwales of the canoe, the opposing handles transversing the top of the storage compartment. Carlson Patent '289 illustrates a storage compartment which conforms to the cross-section of the canoe geometry.

U.S. Pat. No. 4,398,488 to Mathieu teaches a removable cooler constructed with tapered side walls to allow for the cooler to be wedged into one end of a canoe. The accompanying design U.S. Pat. No. Des. 273,074 to Mathieu, discloses the tapered construction, handles, lid and locks.

U.S. Pat. No. 4,593,642 to Shay discloses a large watertight carrying case designed to securely straddle the center thwart of a canoe and having multiple securing latches which grip the gunwales of a canoe. To aid in flotation for subsequent righting, if the canoe overturns, the cover for this device extends four to five inches above the canoe lip.

U.S. Pat. No. 4,146,279 to Stahel teaches a cooler designed for placement over a platform style seat. Stahel Patent '279 illustrates the container as a portable food and beverage cooler for use in a boat, or on a ballpark bench, rather than in a canoe.

U.S. Pat. No. 5,050,526 to Nelson discloses a multiple compartment container attachment for a boat in which two of the compartments are inter-connected allowing the free flow of water between the two compartments, one for live bait and one for live fish. Nelson Patent '526 illustrates attachment to a boat by adjustable, flexible straps which hook over the edge of the gunwales of a boat.

SUMMARY OF THE INVENTION

The present invention functions as a removable, multiple compartment utility container, suitable for storage of dry and/or wet goods, and which easily fits in canoes. The dimensions of the present invention provide a low center of gravity to increase the stability of the canoe when objects are placed in the compartments. The principal objective of the present invention is to circumvent the typical conditions, such as taking on water, or capsizing, due to load shifts, which especially occur in swift currents, while at the same time, accommodating the cooler, storage and seating needs of the canoeists. Existing inventions fail to address the problems which result from the load shifting, or movement, of wet and dry goods typically stored in containers placed inside a canoe. Thus, the inside of the present invention is divided, by vertical interior walls, into multiple separate compartments, preferably three, which prohibit shifting of the loads or contents of the compartments, including water from melted ice.

Versatile storage is another object of this invention. The multiple compartments, created by the vertical interior walls, may be designed for a combination of uses, such as for iced goods and dry stowage. Additional vertical interior dividing walls, and thus interior compartments, may be added for larger style canoes, where the dimensions of the present invention are increased. In the present invention, the preferable number of compartments is three.

Drain plugs are recommended for compartments used as coolers or ice chests, to allow for the easy release of melted water. However, no drain plug is required for a dry goods compartment. In a preferred embodiment, two vertical interior dividing walls separate three compartments; the two outer compartments would contain drain plugs for use as an ice chest or cooler, and the inner compartment, for dry stowage, would not have a drain plug.

Unlike Nelson Patent '526, the present invention teaches one cover for all compartments of the container. A sufficiently watertight seal is created for the individual interior compartments, as well as the overall invention, preventing the flow of water (or any other liquid) from one compartment to another and from the environment into the present invention at a rate which would adversely affect the load shifting inhibition features of the present invention. Additionally, Nelson Patent '526 teaches attachment to the gunwales of a boat by multiple adjustable and flexible straps, which is not required to secure the present invention to the canoe.

A central object of this invention is a utility storage container which fits into typical canoes. Thus, the curvature from front to back and from top to bottom of the end sides of the present invention is designed to match the curvature of the sides of most canoes. The present invention may be modified, by increasing or decreasing the dimensions, to fit canoes which are larger or smaller than the standard canoe. Thus, the present invention may be utilized in any size canoe.

The shape of the present invention, as shown in the drawings of a preferred embodiment, is a trapezoid. The back side is larger than the front side, and the top is larger than the bottom. Thus, in both vertical and horizontal cross-sections, the present invention is trapezoid shaped. It should be noted that the present invention may be modified, in an equally preferred embodiment, where the width of the back side is less than the width of the front side.

The present invention improves upon Carlson Patent '289 in several ways. Carlson Patent '289 teaches a single compartment cooler which is secured to the gunwales of a canoe by a clamp attachment. The present invention discloses a multiple compartment container, having both a height less than the walls of a canoe and a secure fit along the walls and bottom of a canoe. These features overcome prior art requiring placement of the container in the end of a canoe, attachment of the container to the gunwales of a canoe, or placement straddling the center thwart of a canoe.

In contrast to Mathieu Patents '488 and D'074, the present invention is not suspended above the bottom of the canoe on the gunwales by railings or rims, but fits securely on the bottom and along the sides of the canoe. Additionally, the present invention is positioned near the middle of a canoe and not wedged to one end as in Mathieu Patents '488 and D'074.

Another object of the present invention is to overcome the limitations of existing containers which extend above the canoe lip. Thus, the height of the invention is limited by the height of the walls of the canoe. This feature offers a low center of gravity and assists in maintaining the stability of a canoe when pinned against an object by swift currents. This feature also provides the useful benefit of adding seating to the canoe.

The Shay Patent '642 requires placement of the single compartment container over the center thwart of a canoe.

Although both Shay Patent '642 and the present invention improve the stability of a canoe, the present invention improves upon Shay Patent '642 by disclosing a multiple compartment container which, unlike Shay Patent '642, may be utilized as an additional seat in the canoe.

An object of the present invention is to add seating. The invention may be modified to include a molded seat in the cover (as in a preferred embodiment), which allows the present invention to function as an additional seat. An additional seat is especially useful in larger canoes when carrying a third person. The compartment walls engage the cover lips to create a seal, and further, to impart strength to the cover. Thus, the multiple compartments prevent the cover from caving in when used as an additional seat.

The present invention, as illustrated in the drawings, includes both a molded seat and a molded ruler. However, the present invention may be made with or without the molded seat or the molded ruler.

Stahel Patent '279, although teaching a multiple compartment container which may be utilized as an additional seat, is not adaptable for use in a canoe due to the special balancing features of a canoe. If placed over the center thwart of a canoe, Stahel Patent '279 would rise above the walls of the canoe creating a high center of gravity and thus decreasing the stability of the canoe. The multiple compartment arrangement of the present invention further improves upon Stahel Patent '279 by providing complete separation of the individual compartments.

An additional object is to allow the present invention to fit into a canoe without sliding about the canoe. To inhibit sliding, the present invention has skid pads on the bottom side. In a preferred embodiment, the skid pads are made of rubber and are placed under the outer interior compartments along a center line from front to back.

These and other objectives of the present invention will become apparent from a description of a preferred embodiment herein, and from the drawings and claims, which will further define the scope of this invention.

DESCRIPTION OF A PREFERRED EMBODIMENTS

Figure 1:
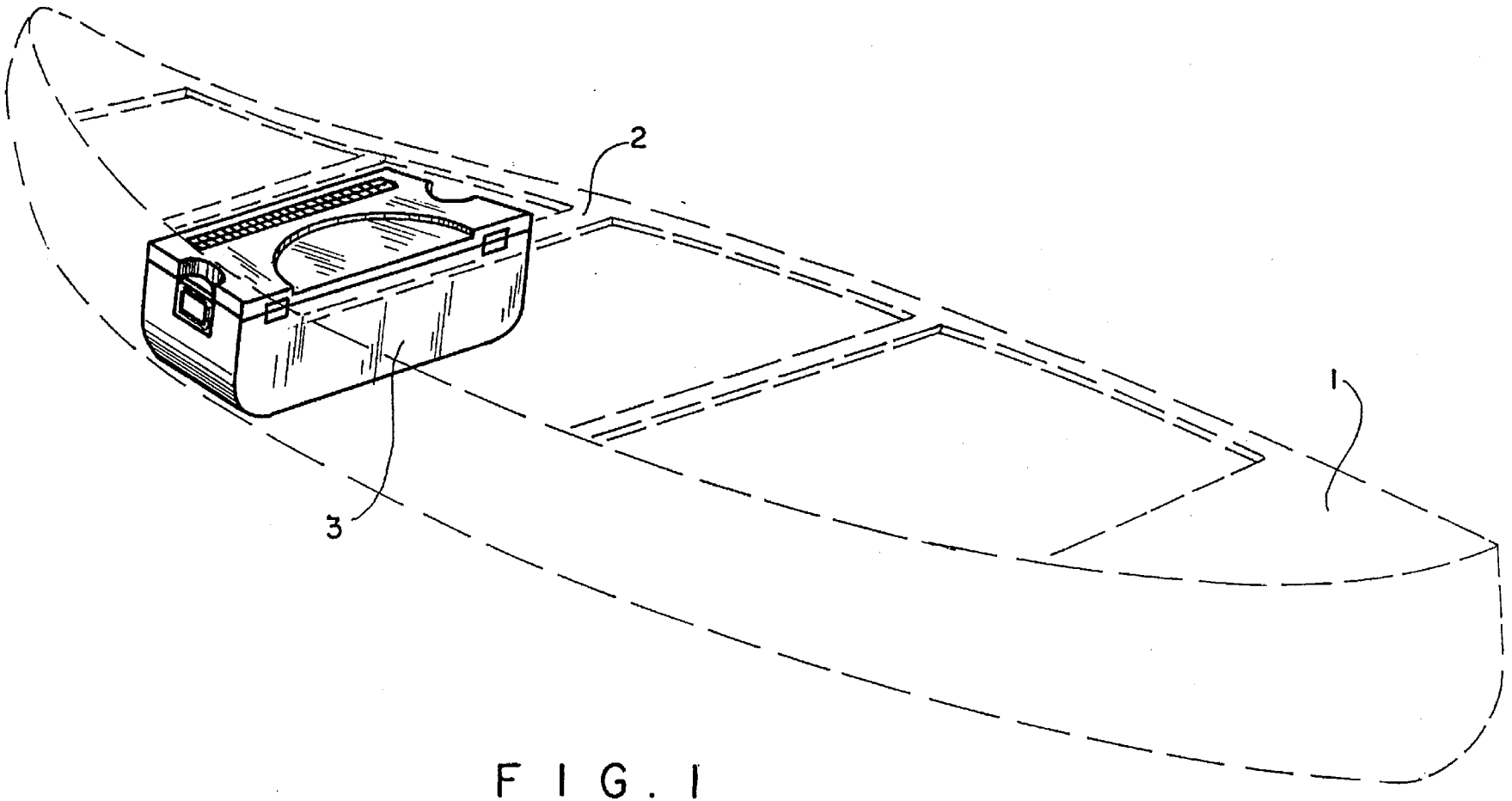
FIG. 1 shows the present invention as it would be placed in a canoe.

The present invention is a multiple compartment utility container for a canoe, shaped in the form of a trapezoid. A preferred embodiment of utility container 3 is shown in FIG. 1, which illustrates the position of utility container 3 relative to center thwart 2 and along the sides and bottom of canoe 1. Utility container 3 is formed of two parts, open chest 4 and chest cover 20. When chest cover 20 is closed over open chest 4, a seal is formed which prevents the flow of liquids both into, or out of, utility container 3 and between the interior compartments of utility container 3 at a rate which would adversely affect the load-shifting inhibition features of the present invention.

Open chest 4 consists of five sides, each having interior and exterior walls: bottom side 5, front side 6, back side 7, end side 8, and end side 9. (See FIGS. 2, 3, & 4.) End sides 8 and 9 connect front side 6 to back side 7 while bottom side 5 supports front side 6, back side 7, end side 8, and end side 9, and creates hollow interior 10 (not shown). The width of front side 6 is less than the width of back side 7. The difference in the width between front side 6 and back side 7 forms the trapezoid shape which allows utility container 3 to fit securely along the sides and the bottom of canoe 1.

Similar to open chest 4, chest cover 20 consists of five sides, each having interior and exterior walls: top side 25, front side 26, back side 27, end side 28, and end side 29 (corresponding in size, shape, and arrangement to front size 6, back side 7, end side 8, and end side 9 of open chest 4, respectively). (See FIG. 5) End sides 28 and 29 connect front side 26 to back side 27, while top side 2S supports front side 26, back side 27, end side 28, and end side 29, and creates hollow interior 24 (not shown). The width of front side 26 is less than the width of back side 27. The difference in the width between front side 26 and back side 27 forms the trapezoid shape which allows utility container 3 to fit securely along the sides and the bottom of canoe 1.

The interior and exterior walls of the five sides of both open chest 4 and chest cover 20 may be made of synthetic, plastic, or natural materials of sufficient strength and hardness to maintain the trapezoid shape of utility container 3, as is well known in the art.

Figure 3:
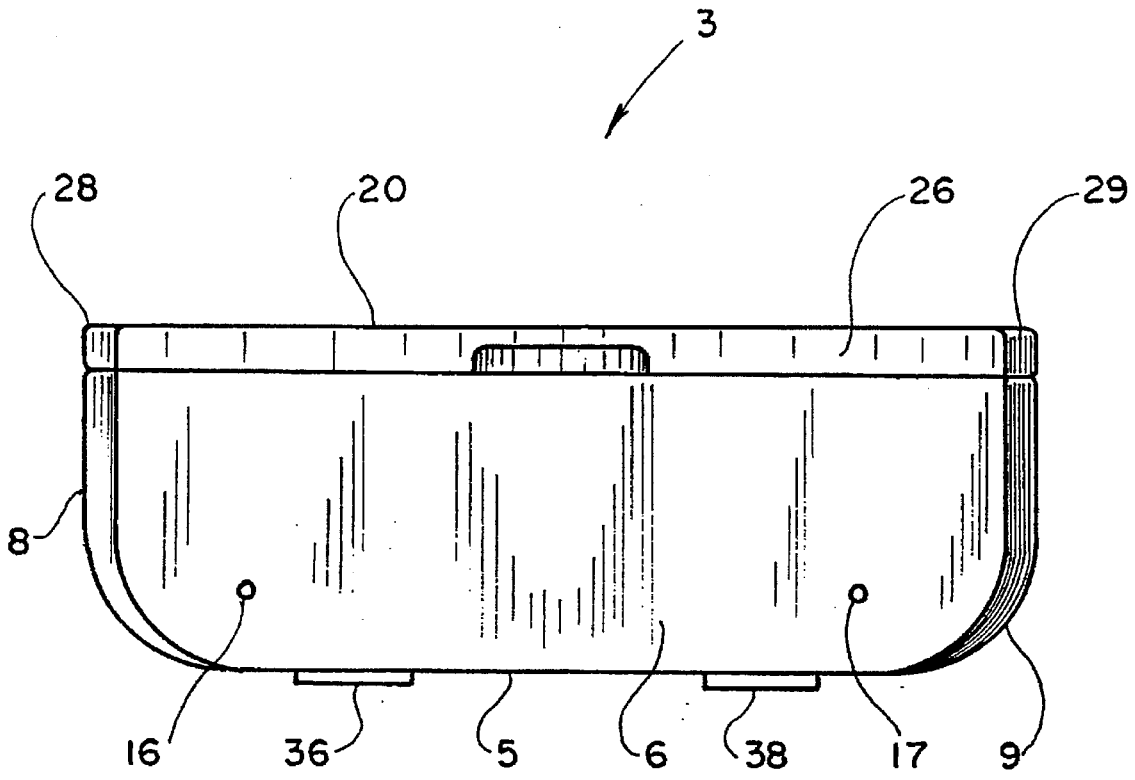
FIG. 3 an elevation view of the present invention with the chest cover closed over the open chest, illustrating the trapezoid shape suitable for fitting along the sides of typical canoes, the skid pads to prevent slipping, a recessed handle for hand opening and closing the chest cover, and the drain plugs in their relative position on the open chest.

To further form the trapezoid shape of utility container 3, the width of bottom side 5 is less than the width of top side 25 due to the curvature of the bottom of canoe 1. When bottom side 5 is connected to top side 25 as shown in FIG. 3 by end sides 8 and 28, and end sides 9 and 29, the difference in the size of bottom side 5 and top side 25 forms the trapezoid shape which allows utility container 3 to fit securely along the sides the bottom of canoe 1. Thus, utility container 3 is, in both vertical and horizontal cross-sections, trapezoid shaped.

As is well known in the industry, typical canoes range in size from 15' to 17' feet in length, 35" to 38" in width (at the center thwart) and 13" to 15" in depth. In order to fit in a typical canoe, and to maintain the trapezoid shape, the dimensions of the preferred embodiment of the present invention are as shown in Table 1:

TABLE 1

| | | |
|---|---|---|
| front side 6 | 31" width | 10.5" depth |
| front side 26 | 31" width | 1.5" depth |
| end sides 8,9 | 18" length | 10.5" depth |
| end sides 28,29 | 18" length | 1.5" depth |
| back side 7 | 32.5" width | 10.5" depth |
| back side 27 | 32.5" width | 1.5" depth |

Thus, for the overall dimensions of the preferred embodiment of the present invention the depth is 12 inches, the lenth is 18 inches, and the width ranges 31" to 32.5" (from front to back).

Figure 2:
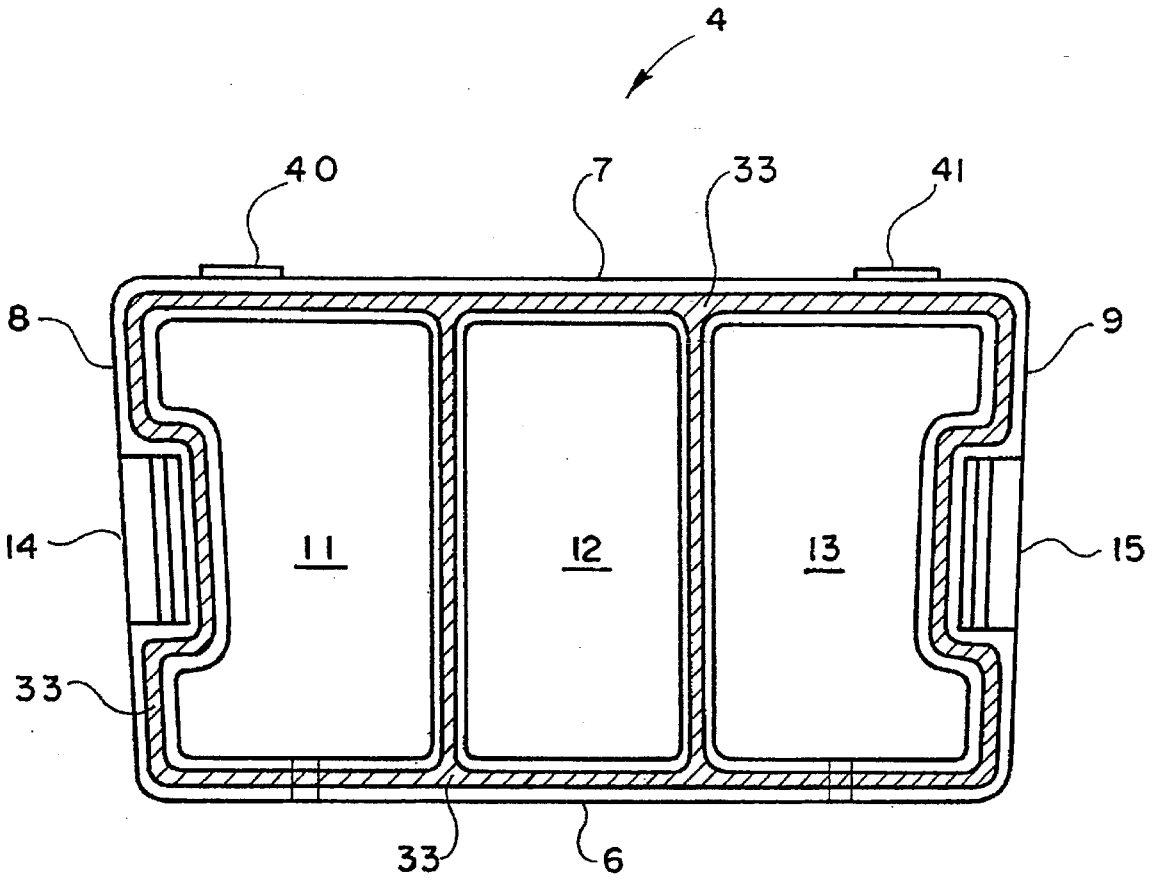
FIG. 2 a plan view of the open chest, with the chest cover removed, showing the trapezoid shape, the multiple vertical interior dividing walls and the compartments created thereby, the recessed handles, and the relative positions of hinges for holding the chest cover on the open chest.
Figure 7:
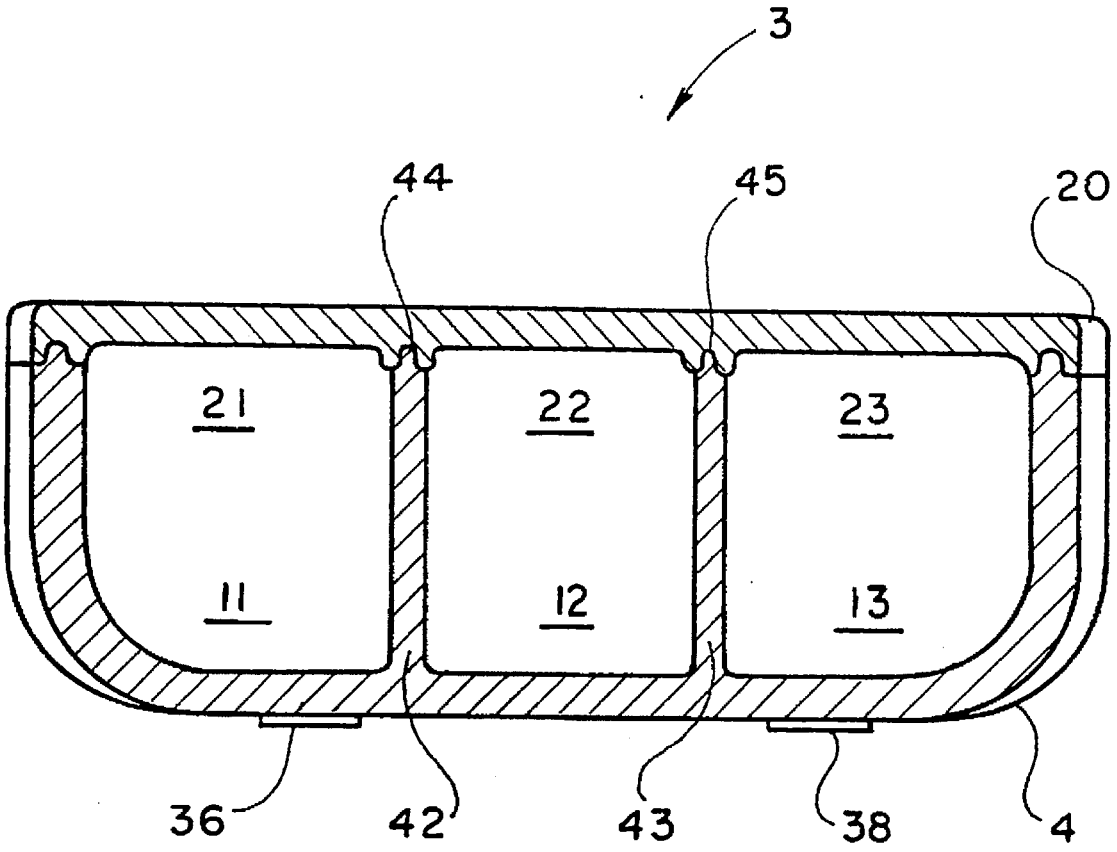
FIG. 7 is a cross section view of the present invention with the chest cover closed over the open chest, detailing the vertical interior dividing walls and the vertical interior dividing lips aligned thereto, which when mated ensures a sufficiently watertight seal for each of the interior compartments and the relative placement of the skid pads.

In a preferred embodiment of utility container 3, as illustrated in FIGS. 2 and 7 hollow interior 10 of open chest 4 consists of two vertical interior dividing walls 42 and 43, which form three interior compartments, 11, 12 and 13. The shape of compartments 11, 12 and 13 is dependent upon the placement of the vertical interior dividing walls within open chest 4, such that inner compartment 12 is rectangular in shape, and outer compartments 11 and 13 are irregular in shape. Additionally, outer compartments 11 and 13 are mirror images of each other due to the overall trapezoid shape of open chest 4.

Figure 6:
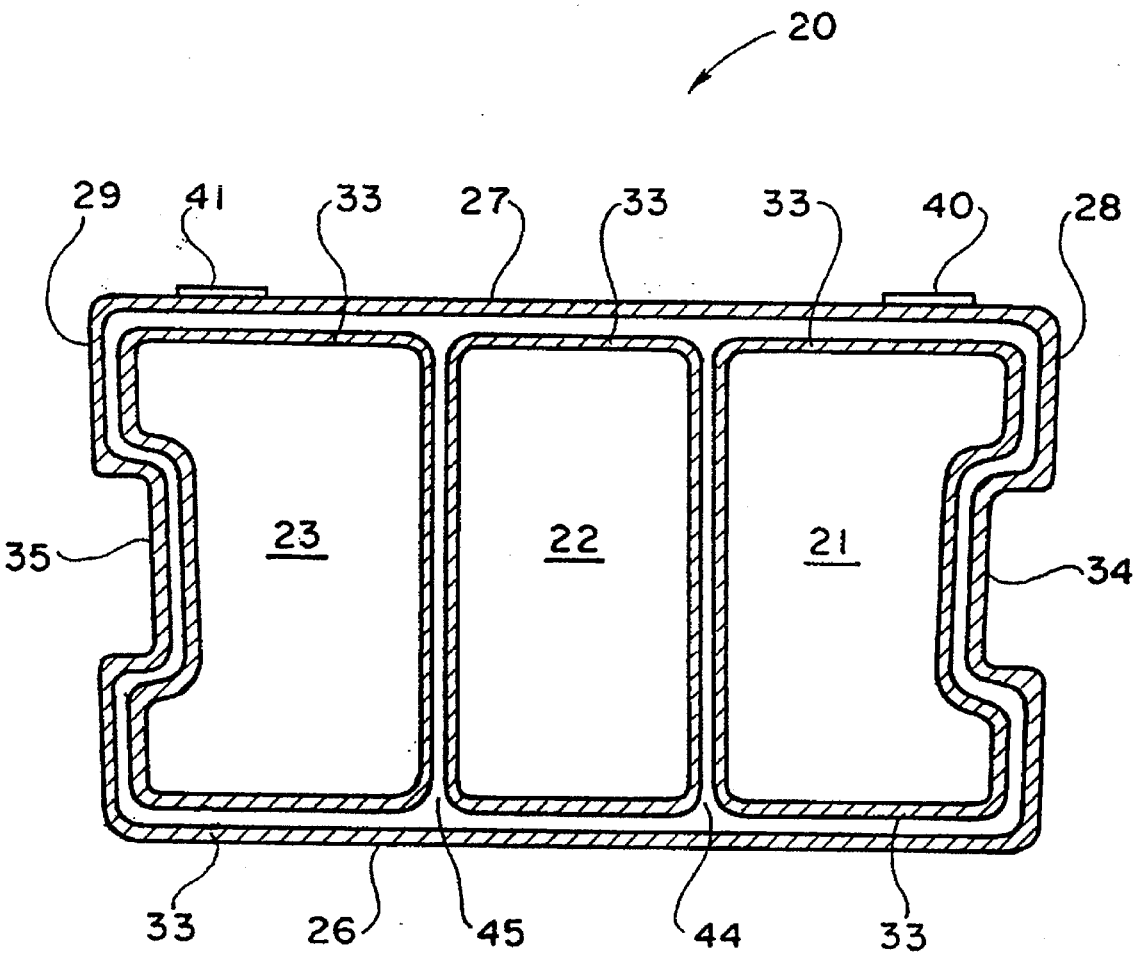
FIG. 6 is a plan view of the bottom side of the chest cover, illustrating the overall trapezoid shape, detailing the vertical interior dividing lips which function to create and to seal each of the interior compartments, and also showing the relative position of the hinges and the recessed handle areas.

Hollow interior 24 of chest cover 20, as shown in FIGS. 6 and 7, consists of two vertical interior dividing lips 44 and 45 (corresponding in alignment to vertical interior dividing walls 42 and 43, respectively), which form three interior compartments 21, 22 and 23 (corresponding in size, shape, and arrangement to interior compartments 11, 12 and 13, respectively). The shape of compartments 21, 22 and 23 is dependent upon the placement of the vertical interior dividing lips within chest cover 20, such that inner compartment 22 is rectangular in shape, and outer compartments 21 and 23 are irregular in shape. Additionally, outer compartments 21 and 23 are mirror images of each other due to the overall trapezoid shape of chest cover 20.

FIG. 7 details the sealing feature which creates a seal between interior Compartments 11, 12, 13 and interior compartments 21, 22, 23, such that water or liquids from one compartment cannot affect the contents of another compartment when chest cover 20 is covering open chest 4. As shown in the preferred embodiment, the sealing feature is created by a raised ridge and groove arrangement whereby a raised ridge on the top of vertical interior dividing walls 42 and 43 and mates with a groove in vertical interior dividing lips 44 and 45.

When chest cover 20 is closed over open chest 4, vertical interior dividing walls 42 and 43 matingly engage vertical interior dividing lips 44 and 45, respectively, sealing the present invention and creating three unified, separate interior compartments by sealably uniting interior compartments 11 and 21, 12 and 22, and 13 and 23. The sealing feature contributes to the stability of utility container 3 by preventing load shifting of the contents of the interior compartments.

In a preferred embodiment of utility container 3, interior compartments 11 and 13 are utilized as coolers or ice chests; therefore, FIGS. 3 and 7 detail drain plugs 16 and 17 which are inserted in drain holes 18 and 19 (not shown), of interior compartments 11 and 13, respectively. Drain plugs 16 and 17 are located on the lower portion of front side 6 in the center of interior compartments 11 and 13, respectively.

As shown in FIGS. 2, 6 and 7, insulating material 33 is present between the interior walls of open chest 4, and the exterior walls of vertical interior dividing walls 42 and 43, which create compartments 11, 12 and 13. Additionally, insulating material 33 is present between the interior walls of chest cover 20, and the exterior walls of vertical interior dividing lips 44 and 45, which create compartments 21, 22 and 23. Insulating material 33 may be made of injected foam insulation or by any other material so utilized by conventional means in the art.

Both end side 8 and end side 9 contain recessed handles 14 and 15, respectively, as detailed in FIG. 2. Recessed handles 14 and 15 allow for utility container 3 to fit securely along the sides of canoe 1. In a preferred embodiment, recessed handles 14 and 15 are pull-out type handles which remain recessed when not in use, as is conventional in the art. However, utility container 3 may be modified such that recessed handles 14 and 15 are molded into end sides 8 and 9, as is known in the art.

Figure 5:
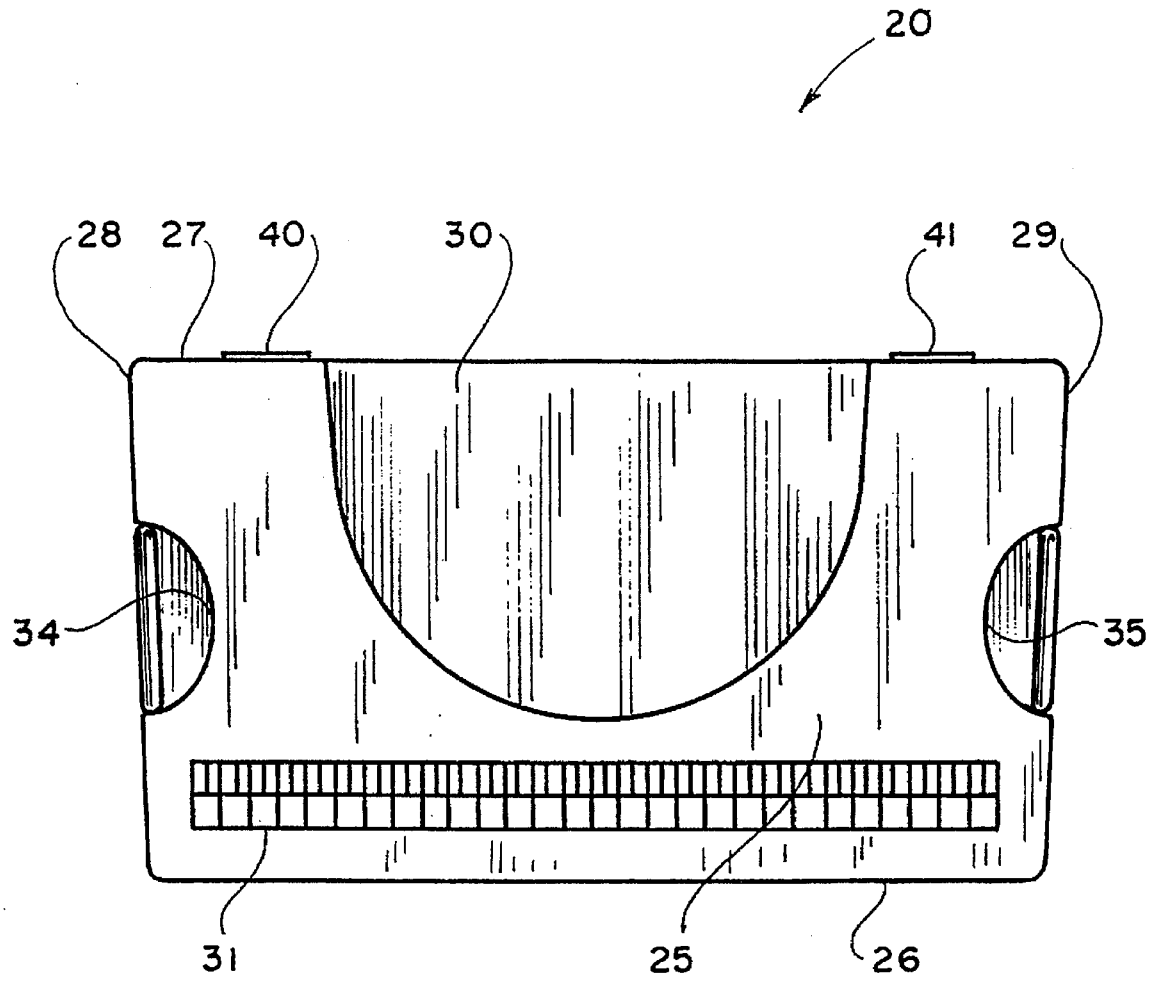
FIG. 5 is a plan view of the top side of the chest cover detailing a molded seat and a molded ruler, the recessed handle areas, and illustrating the trapezoid shape for fitting securely in the canoe.

Chest cover 20 further consists of recessed handle areas 34 and 35. FIG. 5 illustrates the relative position of recessed handle areas 34 and 35 on end sides 28 and 29, respectively. Recessed handle areas 34 and 35 correspond in size, shape and position to recessed handles 14 and 15.

Holding chest cover 20 on open chest 4 are hinges 40 and 41, which are attached to back side 7 of open chest 4 and back side 27 of chest cover 20. In a preferred embodiment, hinges 40 and 41 are placed exterior to compartments 11 and 21, and 13 and 23, respectively. Additionally, to further secure chest cover 20 to open chest 4, when chest cover 20 is covering open chest 4, an internal snap may be located on front side 26 of chest cover 20.

Figure 4:
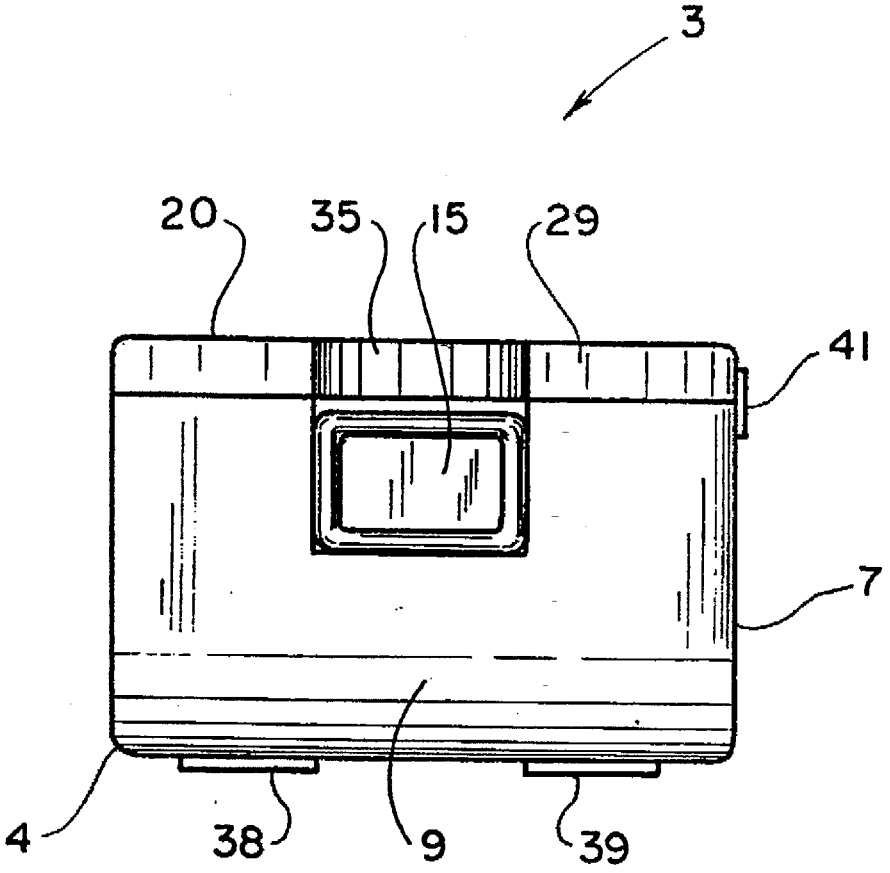
FIG. 4 is an elevation view of one end side of the present invention with the chest cover closed over the open chest, showing the relative position of a recessed handle, a hinge for holding the chest cover to the open chest, the placement of the cover, and the relative position of the skid pads.

In order to prevent slipping and to assist in securely fitting utility container 3 in canoe 1, skid pads are affixed to the exterior of bottom side 5 of open chest 4. Shown in FIGS. 3 and 4 are skid pads 36, 38, and 39, which are positioned along the center line running from front side 6 to back side 7 under interior compartments 11 and 13, respectively. In a preferred embodiment, skid pads 36, 38 and 39 (as well as corresponding skid pad 37 which is not shown), are made of rubber and are affixed with glue to the exterior of bottom side 5 of open chest 4.

In a preferred embodiment of utility container 3, chest cover 20 additionally consists of molded seat 30 and molded ruler 31 which are formed into top side 25 of chest cover 20 by conventional means. In a preferred embodiment, molded seat 30 is fashioned into top side 25 of chest cover 20 so that the legs of the canoeist sitting on utility container 3 will fall over back side 27 of chest cover 20 and over center thwart 2. Additionally, in a preferred embodiment, molded ruler 31 is located near front side 26 of top side 25 of chest cover 20.

Those skilled in the art will find it apparent that changes, modifications and variations can be made in the details of construction and the arrangement of components of the present invention described herein without departing from the spirit or scope of the invention or from the applicant's general inventive concept. Accordingly, it is to be understood that the present invention is not limited to the specific details and illustrative examples as shown and described, but the scope of the present invention is to be measured by the claims herein and equivalents thereof.

I claim:

1. A removable multiple compartment utility container for use in a canoe, comprising:

a. An insulated trapezoid shaped open chest with at least one insulated vertical interior dividing wall;

b. An insulated trapezoid shaped chest cover with at least one insulated vertical interior dividing lip, wherein said chest cover is of a complimentary size, shape and arrangement to cover said open chest and wherein said lip is aligned with said wall, and wherein said chest cover and said open chest, when said chest cover is covering said open chest, have a combined height sufficient to fit within said canoe;

c. A means for holding said chest cover on said open chest, wherein a sufficiently watertight seal is maintained when said chest cover is covering said open chest;

d. A means for sealing said open chest with said chest cover when said chest cover is covering said open chest, wherein said lip is aligned with said wall and a seal is formed thereby such that any contents which may be contained therein are prevented from shifting.

2. The invention of claim 1, wherein said holding means is comprised of a plurality of hinges which are attached to one side of said open chest and to a corresponding side of said chest cover.

3. The invention of claim 1, further comprising a molded seat which is incorporated into said chest cover.

4. The invention of claim 1, further comprising a molded ruler which is incorporated into said chest cover.

5. The invention of claim 1, further comprising a molded seat and a molded ruler, both of which are incorporated into said chest cover.

6. The invention of claim 1, further comprising a pair of recessed handles located on opposite sides of said open chest and a pair of recessed handle areas located on corresponding opposite sides of said chest cover, wherein said pair of recessed handle areas corresponds in size, shape, and arrangement to said pair of recessed handles.

7. The invention of claim 6, wherein said pair of recessed handles are pull-out type handles, and said pair of recessed handle areas are molded into said chest cover such that said pair of recessed pull-out type handles are easily accessed through said pair of recessed handle areas.

8. The invention of claim 1, wherein said sealing means further comprises a ridge on said wall matingly engages a groove in said lip.

9. A removable multiple compartment utility container for use in a canoe, comprising:

a. An insulated trapezoid shaped open chest with a plurality of insulated vertical interior dividing walls;

b. An insulated trapezoid shaped chest cover with a plurality of insulated vertical interior dividing lips identical in number to said walls, wherein said chest cover is of a complimentary size, shape and arrangement to cover said open chest and wherein said lips are aligned with said walls, and wherein said chest cover and said open chest, when said chest cover is covering said open chest, have a combined height sufficient to fit within said canoe;

c. A means for holding said chest cover to said open chest, wherein a sufficiently watertight seal is maintained when said chest cover is covering said open chest;

d. A means for sealing said open chest with said chest cover when said chest cover is covering said open chest, wherein said lips are aligned with said walls and a seal is formed thereby such that any contents which may be contained therein are prevented from shifting;

e. a pair of recessed handles located on opposite sides of said open chest and a pair of recessed handle areas located on corresponding opposite sides of said chest cover, wherein said pair of recessed handle areas corresponds in size, shape, and arrangement to said pair of recessed handles.

10. The invention of claim 9, further comprising a molded seat which is incorporated into said chest cover.

11. The invention of claim 9, further comprising a molded ruler which is incorporated into said chest cover.

12. The invention of claim 9, further comprising a molded seat and a molded ruler, both of which are incorporated into said chest cover.

13. The invention of claim 1, wherein said pair of recessed handles are pull-out type handles, and said pair of recessed handle areas are molded into said chest cover such that said pair of recessed pull-out type handles are easily accessed through said pair of recessed handle areas.

14. The invention of claim 9, wherein said sealing means further comprises a ridge on said wall matingly engages a groove in said lip.

* * * * *

UNITED STATES PATENT AND TRADEMARK OFFICE

CERTIFICATE OF CORRECTION

PATENT NO. : 5,662,061

DATED : September 2, 1997

INVENTOR(S) : Gregg Joseph Salathe

It is certified that error appears in the above-indentified patent and that said Letters Patent is hereby corrected as shown below:

column 5 line 5 -- "top side 2S supports" -- should read -- top side 25 supports --.

column 8 line 49 -- "of claim 1, wherein" -- should read -- of claim 9, wherein --.

Signed and Sealed this

Twenty-fifth Day of November, 1997

*Attest:*

*Attesting Officer*

Bruce Lehman

BRUCE LEHMAN

*Commissioner of Patents and Trademarks*